US005692855A

United States Patent [19]

Burton

[11] Patent Number: 5,692,855

[45] Date of Patent: Dec. 2, 1997

[54] AUTOMATIC QUICK-CONNECT COUPLER FOR IMPLEMENTS

[75] Inventor: Paul Burton, Lee, Ill.

[73] Assignee: Farmers' Factory Co., Lee, Ill.

[21] Appl. No.: 663,593

[22] Filed: Jun. 14, 1996

Related U.S. Application Data

[63] Continuation of Ser. No. 263,086, Jun. 21, 1994, abandoned.

[51] Int. Cl.[6] ..... F16B 2/18

[52] U.S. Cl. ..... 403/325; 403/322; 403/27; 37/468; 37/906; 414/723; 172/272

[58] Field of Search ..... 403/322, 321, 403/324, 325, 326, 327, 49, 27, 24; 37/468, 906, 231; 414/723; 292/42; 285/93; 172/272

[56] References Cited

U.S. PATENT DOCUMENTS

| | | | |
|---|---|---|---|
| 3,672,521 | 6/1972 | Bauer et al. | 414/723 |
| 4,030,624 | 6/1977 | Matthews | 172/272 X |
| 4,793,100 | 12/1988 | Harding et al. | 49/394 |
| 4,984,957 | 1/1991 | Noguchi et al. | 414/723 |
| 5,010,962 | 4/1991 | Bloom, Jr. | 37/906 X |
| 5,263,810 | 11/1993 | Takekata et al. | 403/322 X |
| 5,419,673 | 5/1995 | Merhar | 172/272 X |

FOREIGN PATENT DOCUMENTS

| | | | |
|---|---|---|---|
| 270504 | 6/1988 | European Pat. Off. | 37/468 |

OTHER PUBLICATIONS

F.F.C. 4000, 4500, 6000, 6500 Quick–Attach Owner's & Operator's Manual (10 pages), Published circa 1992.

*Primary Examiner*—Harry C. Kim
*Attorney, Agent, or Firm*—Leydig, Voit & Mayer, Ltd.

[57] ABSTRACT

The coupler is attached to the boom of a tractor or other vehicle and enables the boom to be quickly and automatically connected to an implement such as a loader bucket. The coupler includes spring-loaded and laterally shiftable pins which automatically latch to the implement when the coupler is shifted forwardly toward the implement. Unlatching of the pins is effected by manually turning an operating handle. The operating handle is connected to the pins by laterally rigid links which cause movement of the handle to follow movement of the pins in all positions of the pins so that the position of the handle serves as a visual indicator as to whether the pins are latched or unlatched.

5 Claims, 4 Drawing Sheets

AUTOMATIC QUICK-CONNECT COUPLER FOR IMPLEMENTS

This is a continuation of application Ser. No. 08/263,086 filed on Jun. 21, 1994, now abandoned.

BACKGROUND OF THE INVENTION

This invention relates to couplings of the type used to mount detachable farm or construction implements on the free end of a movable boom of a tractor, loader or the like.

For many years, the assignee of the present invention has made quick-attach couplings adapted for connection to the boom and having spring-loaded pins which, when the coupling approaches the implement, are cammed laterally inwardly toward unlatched positions and then spring laterally outwardly into latching engagement with the implement. As a result, the boom may be connected to the implement automatically simply by moving the boom and the attached coupling toward the implement and without performing any manual operation.

Unlatching of the implement from the coupling is effected by manually turning an actuator from a normal position to an unlatched position in order to retract the pins to their unlatched positions. In prior automatic couplers of this type, the rotary actuator is connected to the pins by flexible cables which pull the pins to their unlatched positions when the actuator is turned to its unlatched position. Once the implement has been detached from the coupling, the springs return the pins to their latched positions and act through the cables to rotate the actuator back to its normal position.

Prior automatic couplers of the above type are disadvantageous in that there are no means of signaling the boom operator whether the pins are fully latched to the implement. In some cases, the coupling may approach the implement but, for one reason or another, the pins may not spring out into latching engagement or full latching engagement with the implement. Accordingly, the operator must leave the tractor and visually inspect the pins to make certain that the implement is securely attached.

SUMMARY OF THE INVENTION

The general aim of the present invention is to provide a new and improved automatic-connect coupling of the above general type which visually signals to the operator whether the pins are latched or unlatched without need of the operator getting off of the tractor or other vehicle and visually inspecting the physical position of the pins.

A related object of the invention is to provide an automatic-connect coupling in which the actuator is prevented from assuming a normal latched position unless the pins are in full latching engagement with the implement, the position of the actuator serving to visually inform the operator of the actual position of the pins.

A more detailed object is to achieve the foregoing by connecting the actuator to the spring-loaded pins by means of laterally rigid links which cause the position of the actuator to follow the position of the pins regardless of whether the pins are fully latched, fully unlatched or disposed in any position between fully latched and fully unlatched.

The invention also resides in the provision of a coupler of the above type having a virtually fully sealed housing for the pins and links so as to prevent contamination from entering the housing and fouling operation of the mechanism therein.

These and other objects and advantages of the invention will become more apparent from the following detailed description when taken in conjunction with the accompanying drawings.

Figure 1:
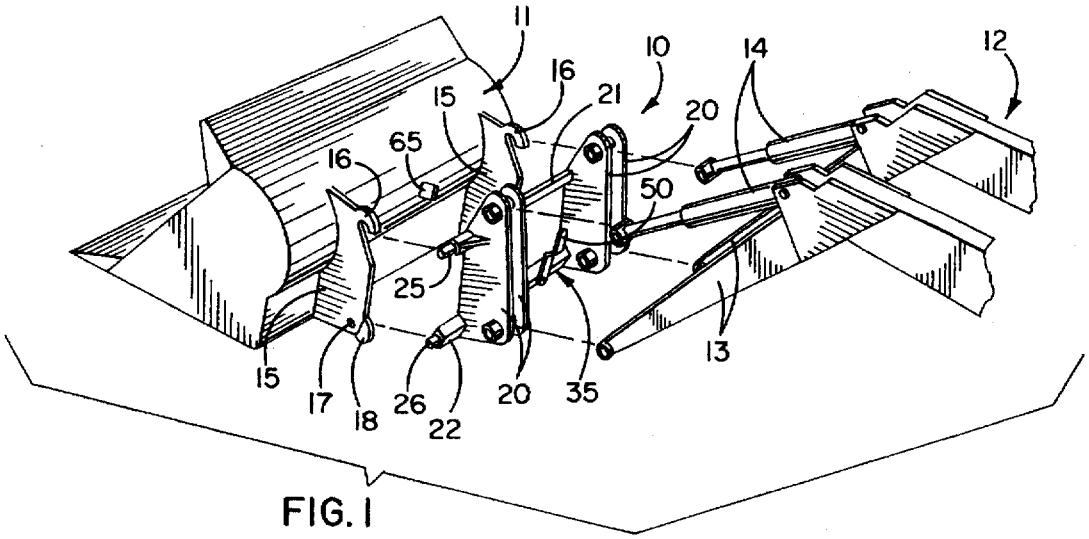
FIG. 1 is an exploded perspective view of a typical boom and a typical implement adapted to be connected by a new and improved automatic-connect coupling incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as embodied in a coupling 10 used to mount an implement such as a loader bucket 11 on the free end of a movable boom 12, the latter being connected at its other end to a loader or tractor (not shown). The boom which has been illustrated includes a pair of laterally spaced arms 13 adapted to be pivoted upwardly and downwardly relative to the tractor. Reciprocating hydraulic actuators 14 are carried by the arms and are used to rock the bucket between various positions.

Figure 3:
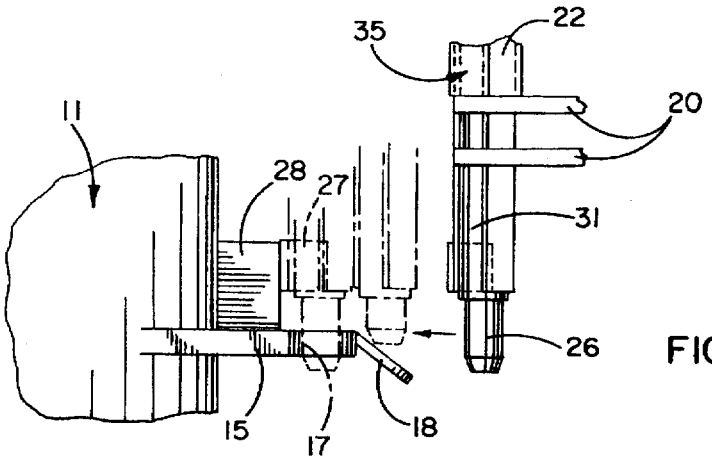
FIG. 3 is an enlarged fragmentary plan view as seen along the line 3—3 of FIG. 2.

The bucket 11 is of conventional construction and includes a rear wall which carries two laterally spaced and generally vertical mounting plates 15. Each plate includes an upper hook 16, a lower laterally extending hole 17 with a bushing (not shown) therein, and a cam wing 18 (FIGS. 1 and 3) located just rearwardly of the hole and inclined so as to angle laterally outwardly upon progressing rearwardly.

As shown most clearly in FIG. 1, the coupler 10 comprises two laterally spaced pair of laterally spaced and upright brackets 20. The four brackets are rigidly connected near their upper ends by a laterally extending bar 21 and are connected near their lower ends by a housing member 22. The lower end portions of the arms 13 of the boom 12 are adapted to be sandwiched between the lower end portions of the brackets 20 and are pivotally connected thereto by pins 23, one of which is visible in FIG. 2. Similarly, the rods of the actuators 14 are adapted to be inserted between the upper end portions of the brackets 20. Pins 24, one of which is visible in FIG. 2, pivotally attach the rods of the actuators to the brackets. Thus, the pins 23 and 24 serve to detachably connect the coupler 10 to the boom 12.

Figure 2:
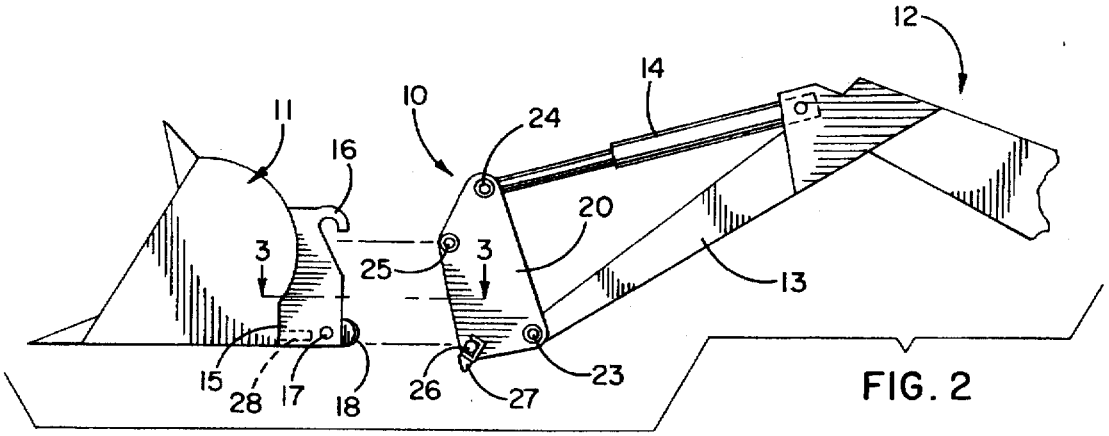
FIG. 2 is a side elevational view showing the coupling connected to the boom and in position to be connected to the implement.

In order to connect the coupler 10 to the bucket 11, the upper end portion of the outboard bracket 20 of each pair carries a fixed and laterally outwardly projecting connector or pin 25. When the coupler 10 is in a downwardly rocked position as shown in FIG. 2, the pins 25 move beneath the hooks 16 of the bucket as the coupler is moved forwardly toward the bucket. Once the pins 25 have been located beneath the hooks, the coupler is raised upwardly to cause the pins to move into latching engagement with the hooks.

In addition to the upper pins 25, the coupler 10 carries a pair of laterally outwardly extending and spring-loaded lower connectors or pins 26 which are adapted to latch into the holes 17 in the plates 15. The pins 26 normally are biased laterally outwardly to latched positions as shown in full lines in FIG. 3. As the coupler is shifted forwardly toward the bucket 11, the pins 26 engage the inclined wings 18 and are cammed laterally inwardly as shown by the right-hand set of phantom lines in FIG. 3. When the coupler is raised to locate the pins 25 within the hooks 16, the pins 26 move into alignment with the holes 17 and, by virtue of being spring-biased, are forced laterally outwardly into the holes so as to latch the lower end of the coupler to the bucket (see the left-hand set of phantom lines in FIG. 3). During forward shifting of the coupler toward the bracket, blocks 27 on the forward side of the end portions of the housing member 22 engage blocks 28 on the inboard sides of the plates 15 to stop forward shifting of the coupler when the pins 26 are aligned horizontally with the holes 17. In addition, the blocks 27 and 28 transmit pushing and lifting forces from the coupler to the bucket and relieve such forces from the pins 26.

Figure 8:
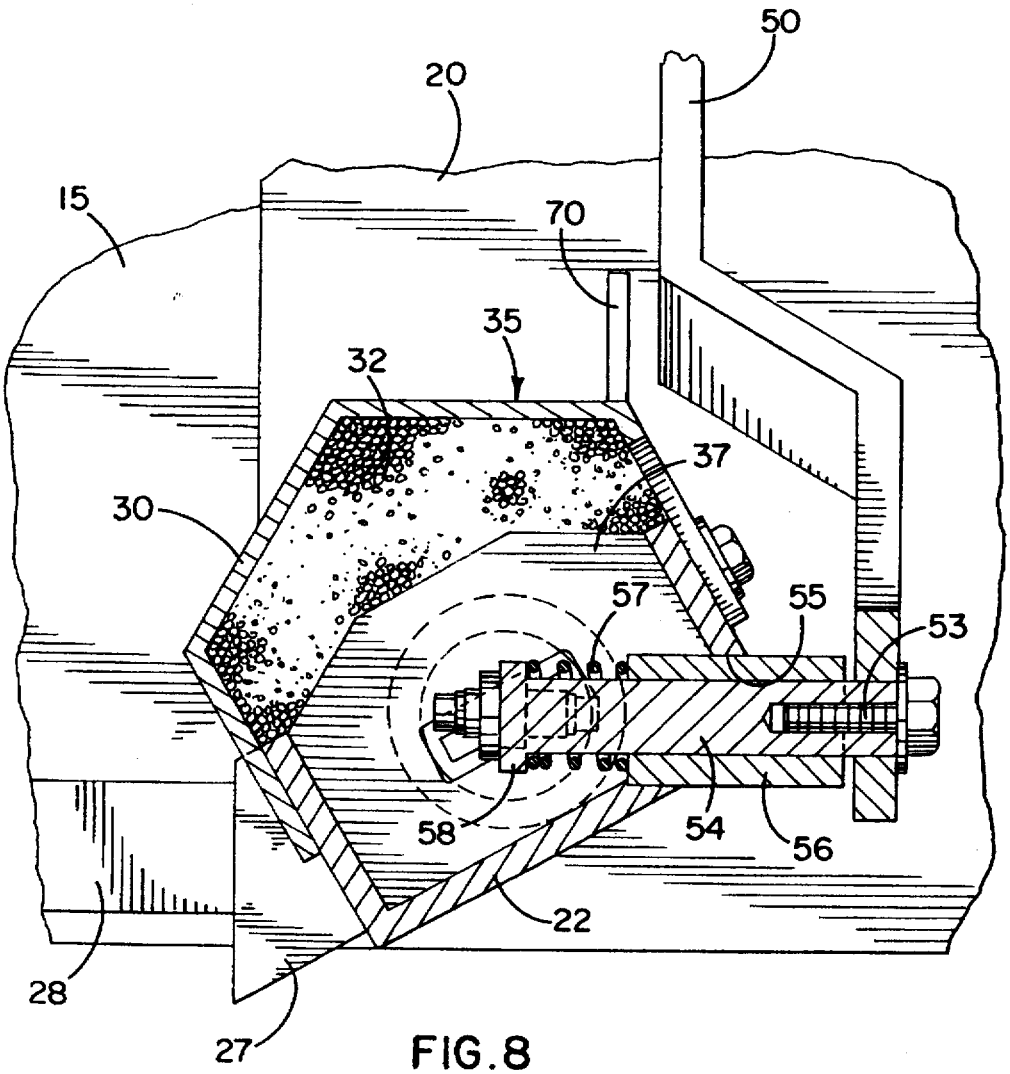
FIG. 8 is an enlarged fragmentary cross-section taken substantially along the line 8—8 of FIG. 5.
Figure 7:
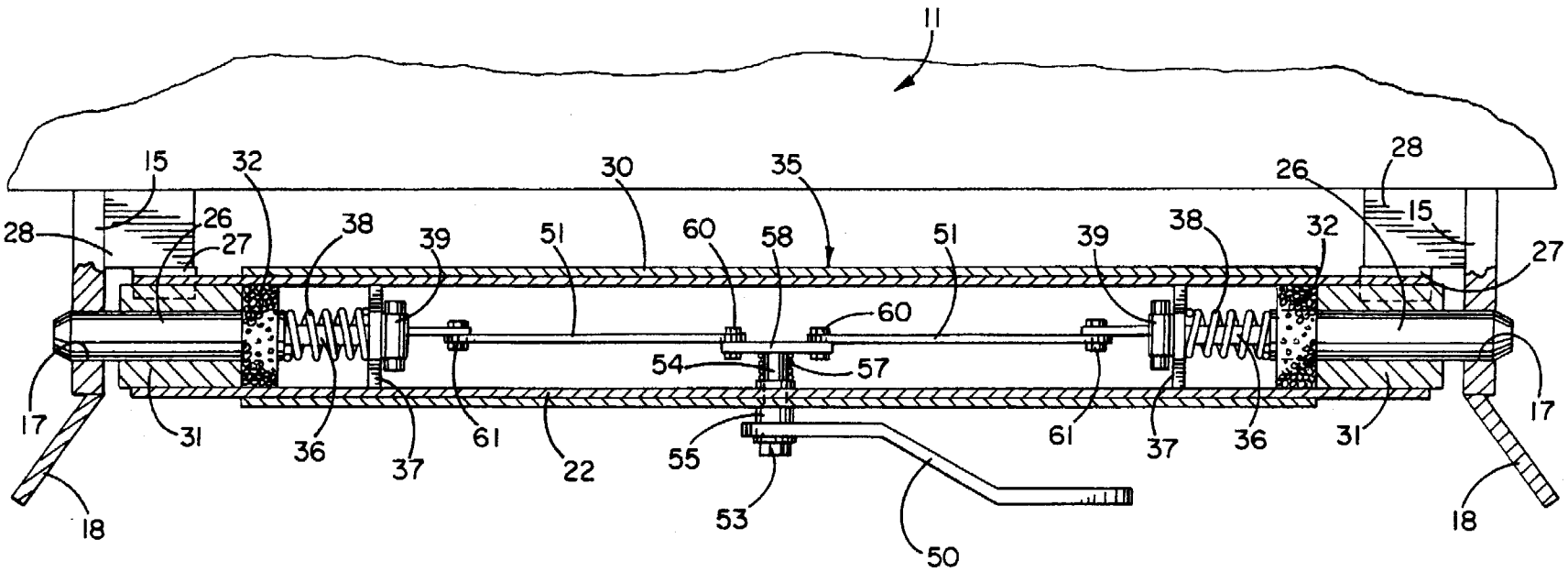
FIG. 7 is a fragmentary cross-section taken substantially along the line 7—7 of FIG. 5.

The housing member 22 is fixed to the brackets 20 and is adapted to be closed by a cover 30 (FIG. 8) suitably connected to the housing member. Sleeves 31 (FIG. 5) fixed to the ends of the housing member guide the pins 26 for inward and outward sliding. The ends of the cover 30 carry foam gaskets 32 (FIGS. 5, 7 and 8) which seal against the sleeves to restrict the entry of dirt and other contamination into the housing 35 defined by the fixed housing member 22 and the cover 30.

A shank 36 (FIG. 5) is attached to the inboard end of each pin 26 and is slidably guided by an upright bracket 37 fixed to the housing member 22. A coiled compression spring 38 is telescoped over each shank and is compressed between the outer side of the bracket 37 and the inner end of the pin 26 to urge the latter outwardly. Fixed to each shank is a stop 39 which engages the inner side of the bracket 37 to limit outward shifting of the pin 26.

By virtue of the cam wings 18 and the spring-loaded pins 26, the bucket 11 may be automatically connected to the coupler 10 by following the procedure described above and without performing any manual operations. In order to disconnect the bucket from the coupler, a manually operable actuator 50 is turned from a latched position (FIG. 5) to an unlatched position (FIG. 6) and, upon being so turned, retracts the pins 26 to unlatched positions out of the holes 17. The coupler 10 then may be detached from the bucket 11 by rocking the coupler downwardly to pull the upper pins 25 downwardly out of the hooks 16 and by backing the coupler away from the bucket.

In accordance with the present invention, the actuator 50 is connected to the pins 26 by laterally stiff links 51 (FIGS. 5–7) which cause the position of the actuator to follow the position of the pins regardless of whether the pins are in their latched positions, their unlatched positions or any position therebetween. As a result, the position of the actuator serves as a visual indicator to the boom operator as to whether the pins 26 are latched fully in the holes 17 and thus the operator need not leave the tractor and visually inspect the pins in order to determine whether the pins are safely latched to the bucket 11.

More specifically, the actuator 50 is in the form of a crank or handle located completely outside of the housing 35 and secured by a screw 53 (FIG. 8) to the rear end of a shaft 54. The latter extends through a hole 55 in the rear side of the housing member 22 and is supported for rotation and for limited axial sliding by a bushing 56 which is fixed to and also extends through the rear side of the housing member. A compression spring 57 is telescoped over the shaft 54 and is compressed between the bushing 56 and a short bar 58 fixed to the forward end of the shaft, the spring serving to urge the handle 50 rearwardly while allowing limited forward sliding of the handle.

Pursuant to the invention, the links 51 are made of laterally stiff bars of steel. The inboard ends of the links are pivotally connected to the ends of the bar 58 as indicated at 60 while the outboard ends of the links are pivotally connected to the shanks 36 of the pins 26 as indicated at 61. With this arrangement, counterclockwise rotation of the actuator handle 50 from the latched position shown in FIG. 5 to the unlatched position shown in FIG. 6 causes the bar 58 to pull on the links 51 and retract the pins 26 to their unlatched positions out of the holes 17. When the handle 50 is released, the springs 38 pull on the links 51 and urge the handle back toward its latched position (FIG. 5).

Figure 5:
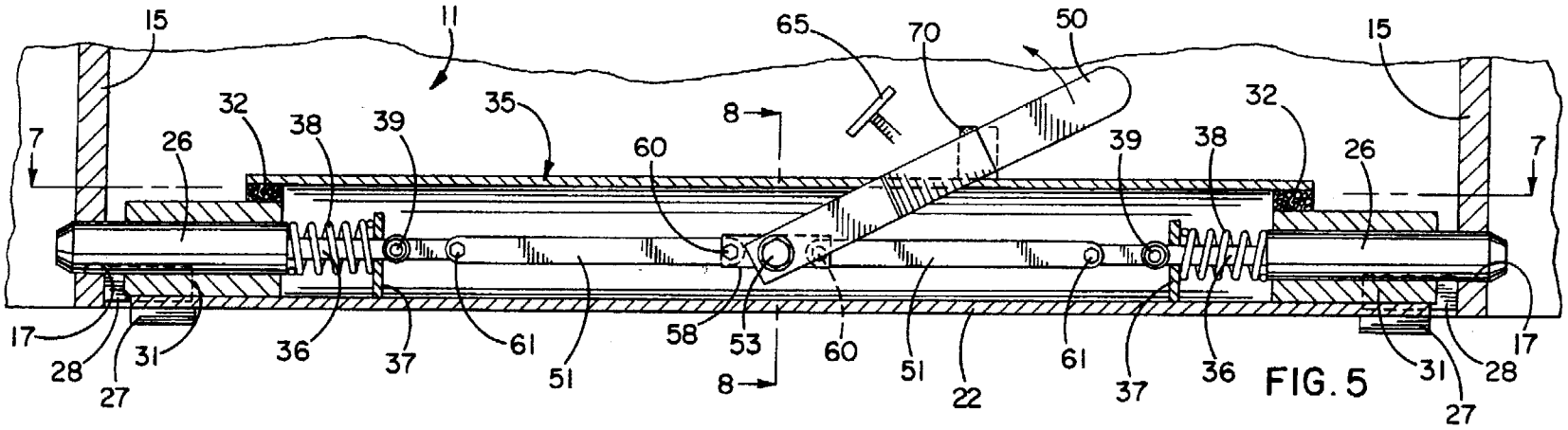
FIG. 5 is an enlarged fragmentary cross-section taken substantially along the line 5—5 of FIG. 4.
Figure 6:
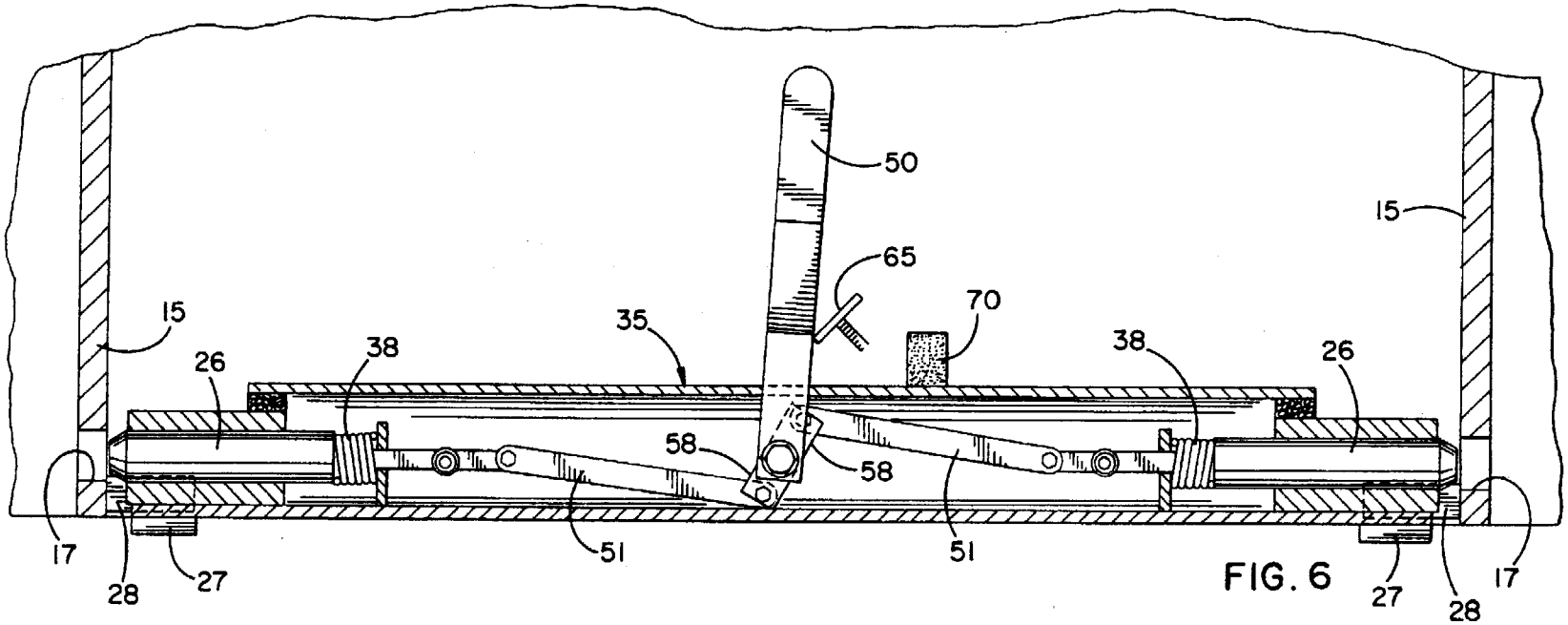
FIG. 6 is a view similar to FIG. 5 but shows certain components of the coupling positioned to enable detachment of the implement from the coupling.
Figure 4:
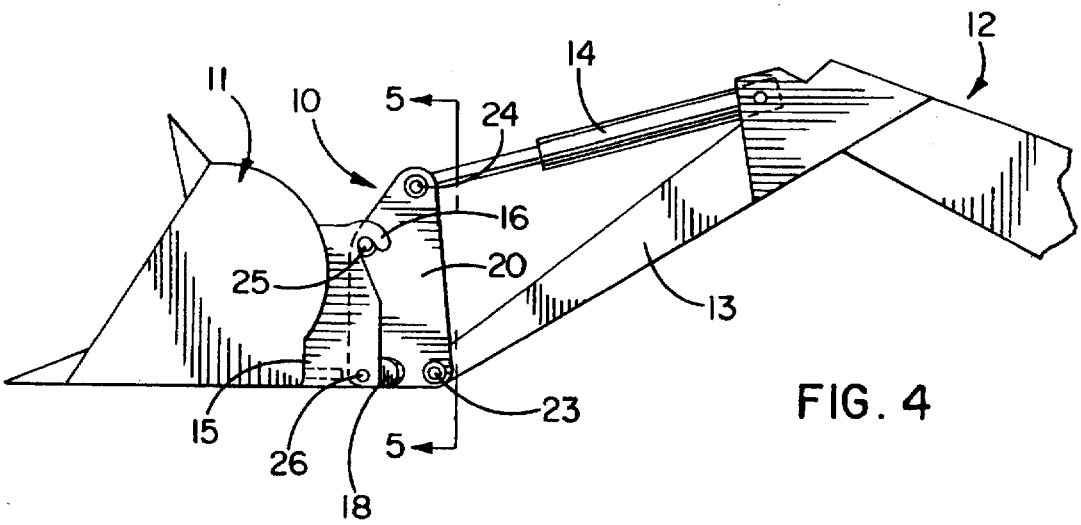
FIG. 4 is a view similar to FIG. 3 but shows the coupling attached to the implement.

To disconnect the bucket 11 from the coupler 10, the operator leaves the tractor, pulls the handle 50 a short distance rearwardly against the action of the spring 57 and then turns the handle counterclockwise from the latched position of FIG. 5 to the unlatched position of FIG. 6 in order to retract the pins 26 from the holes 17. After turning the handle to its unlatched position, the operator—while holding the handle against turning—releases the handle to the action of the spring 57 to enable the spring to shift the handle forwardly. Upon being shifted forwardly, the handle moves into opposing relation with a stop 65 (FIGS. 5 and 6) on the rear side of the bucket 11. Engagement of the handle with the stop prevents the handle from returning clockwise toward its latched position and thus keeps the pins 26 retracted. Accordingly, the operator may return to the tractor, rock the coupler downwardly and then back the coupler away from the bucket so as to detach the bucket from the coupler. As the coupler is backed away from the bucket, the handle 50 moves rearwardly out of engagement with the stop 65 and, at that time, the springs 38 force the handle clockwise toward its latched position as an incident to urging the pins 26 laterally outwardly toward their latched positions.

When the coupler 10 is re-connected to the bucket 11, the rigid links 51 force the handle 50 to first turn counterclockwise and then to turn clockwise as the pins 26 are first cammed laterally inwardly by the wings 18 and then spring into the holes 17 in the plates 15. If the pins 26 latch fully in the holes 17, the handle 50 returns clockwise to its fully latched position. If for some reason, however, either pin 26 fails to enter or fully enter the adjacent hole 17, the rigid links 51 prevent the handle from returning fully to its latched position. Accordingly, the operator may observe the position of the handle to determine whether the pins 26 are fully and safely latched without need of leaving the tractor to inspect the pins themselves. If the pins 26 do not latch on the first attempt, the operator may repeat the connecting operation until such time as the pins do latch.

To assist the operator in determining whether the handle 50 is in its fully latched position, provision is made of warning indicia to signal the location of the handle. Herein, the warning indicia takes the form of a metal flag 70 (FIGS. 5, 6 and 8) attached to and projecting upwardly from the cover 30 and preferably painted red. The flag 70 is located in front of the handle 50 and is covered or substantially covered when the handle is in its fully latched position (see FIG. 5). If the handle is not in that position, the flag is partially or completely exposed to the view of the operator as shown in FIG. 6 and warns the operator of the unlatched condition.

The present coupler 10 not only has the warning feature provided by the handle 50 and the flag 70 but also includes a housing 35 which is less susceptible to becoming contaminated by dirt and trash. Because the handle is located completely outside of the housing, there is no need of a handle-accommodating slot in the housing, as is the case with prior couplers, and thus contamination is less likely to enter the housing and foul the components therein.

The coupler 10 which has been specifically disclosed includes a single handle 50 operably coupled to two links 51 which, in turn, are connected to the pins 26. The principles of the invention are applicable, however, to couplers of the type in which a separate operating handle is provided for each spring-loaded pin. In such a case, each handle is connected to its respective pin by a laterally stiff link which forces movement of the handle to follow movement of the pin regardless of the position of the pin.

I claim:

1. A coupling for use in detachably connecting a movable boom to a back side of an implement and having manual and quick connect coupling modes for connecting the boom and implement, said coupling comprising a bracket having means adapted for pivotal connection to said boom, said bracket having a laterally extending connector adapted to be releasably coupled to said implement, a housing connected to said bracket and supporting said connector to slide laterally inwardly to an unlatched position and laterally outwardly to a latched position, a manually operable actuator accessible from outside of said housing and rotatably supported by said housing for movement between unlatched and latched positions, said actuator also being translationally movable with respect to the housing, a laterally rigid link located in said housing and pivotally connected to said actuator and said connector, said link being operable upon manual rotation of said actuator toward its latched position to push said connector toward its latched position for manual coupling and being operable upon manual rotation of said actuator toward its unlatched position to pull said connector toward its unlatched position for manual uncoupling, a spring urging said connector toward its latched position and yielding to enable said connector to move toward its unlatched position in the quick connect coupling mode independently of manual operation of said actuator, the actuator being unrestricted so that it is free to be driven in rotation through said link by movement of the connector inwardly toward its unlatched position during the quick connect coupling mode to rotate the actuator toward its unlatched position thereby to indicate the position of the connector, said link causing said actuator to turn from its latched position toward its unlatched position whenever said connector is moved toward its unlatched position independently of manual operation of said actuator.

2. A coupling as defined in claim 1 further including a visual warning indicia on said housing, the relationship between said actuator and said warning indicia being at a first condition when said actuator is in its latched position and being at a second and different condition when said actuator is in its unlatched position.

3. A coupling as defined in claim 1 further including a warning flag on said housing and positioned in front of said actuator, said flag being substantially covered by said actuator when said actuator is in its latched position and being substantially exposed to view when said actuator is in its unlatched position.

4. A coupling as defined in claim 1 in which said actuator includes a handle located completely outside of said housing, a hole in said housing, and a shaft rotatably supported within said hole and connecting said handle to said link.

5. A coupling for use in detachably connecting a movable boom to a back side of an implement and having manual and quick connect coupling modes for connecting the boom and implement, said coupling comprising laterally spaced brackets each having means adapted for pivotal connection to said boom, each of said brackets having upper and lower laterally extending connectors adapted to be releasably coupled to said implement, a housing connected to and extending between said brackets and supporting said lower connectors to slide laterally inwardly to unlatched positions and laterally outwardly to latched positions, a manually operable actuator accessible from outside of said housing and rotatably supported by said housing for movement between unlatched and latched positions, said actuator also being translationally movable with respect to the housing, laterally rigid link means located in said housing and pivotally connected to said actuator and said lower connectors, said link means being operable upon manual rotation of said actuator toward its latched position to push said lower connectors toward their latched positions for manual coupling and being operable upon manual rotation of said actuator toward its unlatched position to pull said lower connectors toward their unlatched positions for manual uncoupling, and springs urging said lower connectors toward their latched positions and yielding to enable said lower connectors to move toward their unlatched positions in the quick connect coupling mode independently of manual operation of said actuator, the actuator being unrestricted so that it is free to be driven in rotation through said link by movement of the connector inwardly toward its unlatched position during the quick connect coupling mode to rotate the actuator toward its unlatched position thereby to indicate the position of the connector, said link means causing said actuator to turn from its latched position toward its unlatched position whenever said lower connectors are moved toward their unlatched positions independently of manual operation of said actuator.

* * * * *